US007861572B2

(12) United States Patent
Geser

(10) Patent No.: US 7,861,572 B2
(45) Date of Patent: Jan. 4, 2011

(54) METHOD AND DEVICE FOR MAKING AT LEAST PARTLY PROFILED TUBES

(75) Inventor: Peter Geser, Stafa (CH)

(73) Assignee: Ernst Grob AG, Mannedorf (CH)

( * ) Notice: Subject to any disclaimer, the term of this patent is extended or adjusted under 35 U.S.C. 154(b) by 1048 days.

(21) Appl. No.: 10/570,389

(22) PCT Filed: Sep. 5, 2003

(86) PCT No.: PCT/CH03/00601

§ 371 (c)(1),
(2), (4) Date: Nov. 20, 2006

(87) PCT Pub. No.: WO2005/023454

PCT Pub. Date: Mar. 17, 2005

(65) Prior Publication Data

US 2007/0271986 A1 Nov. 29, 2007

(51) Int. Cl.
*B21D 41/00* (2006.01)

(52) U.S. Cl. ..... 72/370.13; 72/370.05; 72/76; 72/96; 72/125

(58) Field of Classification Search ..... 72/76, 72/85, 96, 115, 125, 370.1, 370.05, 370.13, 72/370.2, 117, 393
See application file for complete search history.

(56) References Cited

U.S. PATENT DOCUMENTS 3,422,518 A 1/1969 French et al.
3,893,321 A 7/1975 Braunwieser
3,899,912 A * 8/1975 Orain ..... 72/344
5,001,916 A 3/1991 Schuler et al.
5,471,858 A * 12/1995 Deriaz ..... 72/83
6,883,358 B2 * 4/2005 Hauf ..... 72/85

FOREIGN PATENT DOCUMENTS

DE 24 48 283 6/1975
DE 37 15393 A1 2/1988
FR 2 301 318 9/1976

* cited by examiner

*Primary Examiner*—Dana Ross
*Assistant Examiner*—Matthew G Katcoff
(74) *Attorney, Agent, or Firm*—Antonelli, Terry, Stout & Kraus, LLP.

(57) ABSTRACT

A method and device are disclosed for producing tubes that are at least partially profiled on their interior and preferably on their exterior from a hollow cylindrical blank (3), using a mechanical cold forming method, wherein the end of the blank (3) that is not to be machined (3') is fed to a clamping device (10). The blank (3) is then secured in the clamping device (10) and a mandrel (2) is subsequently inserted into the end of region (3) of the blank (3) that is to be machined. A lance (8) is guided in the mandrel so that it can be coaxially displaced in a longitudinal direction and the free end of the lance (8') can be introduced into the clamping device (10). The tip (8') of the lance (8) is then brought into a positive fit with the clamping device (10) in the axial direction of the blank (3) and the mandrel (2), together with the clamping device (10) and the blank (3) is guided axially through a fixed machining point (6). Radial exterior machining of the surface of the blank (3) along the section that is to be machined (3') takes place at the machining point (6), to create the interior and exterior profiling of the blank (3). During the process, the mandrel (2) is preferably rotated about its axis in an intermittent manner.

13 Claims, 7 Drawing Sheets

METHOD AND DEVICE FOR MAKING AT LEAST PARTLY PROFILED TUBES

RELATED APPLICATION

This application is a U.S. national phase application under 35 U.S.C. §371 of International Application No. PCT/CH2003/000601 filed Sep. 5, 2003.

TECHNICAL FIELD

The present invention relates to a method for making at least partially profiled tubes, at least on the inside, from a hollow cylindrical blank, as well as a device for carrying out the method.

BACKGROUND

Profiled tubes or tube segments are made, for example, in the automotive industry for use as sliding pieces for articulated shafts or movable steering columns. As a rule, two tubes are always used, which can slide lengthwise relative to each other, being form-fitted together in regard to rotation about their lengthwise axis. In this way, it is possible to compensate for changes in the interval between the end points of these tubes, while at the same time transmitting a precise rotation. These requirements, as already mentioned, are necessary for both the drive train and the steering in motor vehicles. At the same time, these tubes need to have the lightest possible construction, having a precise profiling with the slightest possible free play, and high strength.

In order to cold-form such thin-walled metal tube segments, being profiled on the inside or outside and having an interlocking profile, one traditionally uses an equally profiled mandrel. This mandrel is introduced into a tube blank and the surface of the blank is worked on mechanically from the outside, for example in the form of impact rollers. This is generally done automatically in a suitably configured production machine. The mandrel needs to have a greater length than the region of the blank being worked on, since the mandrel for the profiling has to remain inserted within the entire length of the blank and then needs to be retracted into the production machine in order to remove the finished workpiece and load a new blank into the production machine.

Thus, this traditional method and the corresponding production machines are only suitable for making tubes of a limited length. If longer tubes need to be made, these production machines reach their limits on account of their dimensions, especially since the mandrel cannot be made arbitrarily longer, due to the higher production costs.

SUMMARY OF INVENTION

The goal of the present invention was to find a method and a device also suitable for making relatively long and at least partly profiled tube segments by means of mechanical forming machines.

This goal is achieved according to the invention by the features of the method of the invention which comprises:

- feeding an end of the blank not to be worked to a clamping mechanism,
- clamping the blank in the clamping mechanism to hold the blank,
- introducing a mandrel arranged on a primary headstock into the end of a region of the blank that is to be worked,
- passing the free end of a lance coaxially through the mandrel and the blank and into the clamping mechanism,

- bringing the lance into a form-fitting connection with the clamping mechanism at least in regard to traction and rotation,
- passing the mandrel axially through a stationary machining stage together with the clamping mechanism and the blank, so that the machining stage works radially on the surface of the blank from the outside, along a segment being worked, in order to create at least the inner profiling of the blank. Preferred embodiments of the invented method further emerge from the following detailed description of an example embodiment and the application claims.

Because the blank is fed by the end of region of the clamping mechanism not subjected to the working process, the length of the mandrel can be chosen to match the length of the region of the blank being worked. In particular, the range of motion of the mandrel can thus be confined practically to the length of the region being worked. The advantage of this is smaller machine dimensions, especially in the area of the drive units and guides. The drive unit of the working station and the rotation drive unit of the mandrel can thus be arranged very compactly on the same machine frame.

Furthermore, the loading of the blank into the clamping mechanism can thus occur outside the working region at the end opposite the mandrel. Likewise, after the working is complete, the finished tube can be unloaded there once again. Thus, both the loading and the unloading process can be done advantageously by means of a single device.

Thanks to the use of a secondary headstock, which is form-fitted to the primary headstock by a lance, one can achieve a very powerful and reliable clamping of the blank for the subsequent working.

With the method of the invention, one can provide an inside and outside profiling, especially for relatively long and thin-walled tube blanks, at least in some regions. As a rule, one creates an axially situated interlocking geometry, so that these tubes are suitable for use as twist-proof telescopic tubes. Such tubes are used, for example, but not exclusively, in automotive engineering, for example, in articulated shafts or steering columns.

The method is especially suitable for use of the impact rolling method as a mechanical forming technique, i.e., the working of blanks radially from the outside by a sequence of hammering or striking operations, using profiled or flat-rolling rolls. In this way, and in familiar fashion, one can produce either meshing only on the inside, or also inside and outside meshing at the same time.

Preferably, the first clamping of the blank is done by a spring-loaded tightening mechanism, which is realized in the clamping direction. That is, the blank is introduced by the loading mechanism into the tightening mechanism and held there for feeding via the mandrel.

Thanks to a form-fitted and/or frictional connection between the primary headstock and the clamping mechanism, a reliable and precise transmission of the rotary motion of the mandrel to the blank is achieved, which ultimately guarantees high precision of machining.

Preferably, the blank is pushed by an axial movement of the clamping mechanism over the mandrel and then jointly through the machining station. The drive units for both the lengthwise movement through the machining station as well as any intermittent rotational movement to produce precise meshing are realized advantageously in the primary headstock.

The goal is further achieved according to the invention by a device of the invention which comprises:

a primary headstock movable along a primary headstock axis;

a mandrel able to travel axially along the primary headstock axis with the primary headstock;

a secondary headstock;

a stationary machining station with cold-forming tools working radially to the primary headstock axis;

wherein the secondary headstock is arranged axially opposite the primary headstock, with a clamping mechanism able to travel coaxially to the primary headstock relative to the machining station;

wherein the machining station is arranged stationary between the primary headstock and the secondary headstock. Preferred embodiments of the invented device further emerge from the following detailed description of an example embodiment and the application claims.

Thanks to the invented arrangement of primary headstock, machining station, and secondary headstock, the most space-saving and compact layout of the device is achieved. The machine frame with the machining station and primary headstock integrated on it does not have larger, or even smaller, dimensions than traditional devices, even though it can handle longer machined regions of the blanks or longer blanks. The areas standing off from this machine frame in order to support and guide the secondary headstock are likewise very space-saving and compact, and furthermore can contain the loading and unloading device for the blanks, or leave enough room free for such devices to gain a purchase.

Thanks to the preferred embodiment of the clamping mechanism with hollow cylindrical envelope and clamping or tightening elements located therein, being partly spring-loaded in their action, a very compact element is created. The rotation of the clamping mechanism or the blank located therein is advantageously accomplished by the lance (or its free end) which is introduced into the clamping mechanism.

BRIEF DESCRIPTION OF DRAWINGS

An exemplary embodiment of the present invention is explained in greater detail below, by means of drawings.

DETAILED DESCRIPTION OF EMBODIMENT

Figure 1:
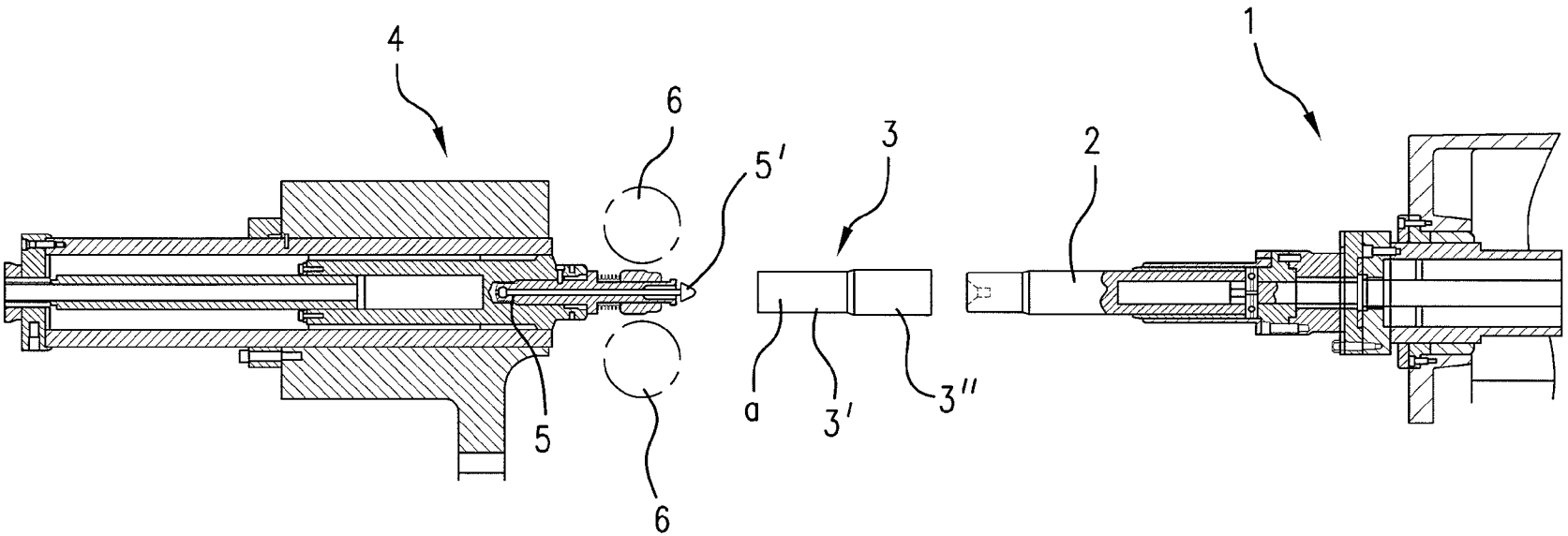
FIG. 1 shows, schematically, the layout of a traditional device for making tubes that are profiled on the inside and outside.

FIG. 1 shows schematically the layout of a traditional device for making tubes profiled on the inside and outside. The device has, at the right side, a headstock 1 with intermittent rotational drive. To the left of the headstock 1 and protruding there is arranged a mandrel 2, having a surface configured in accordance with the profiling to be imposed on the blank 3.

The blank 3 has two diameter regions, a first region 3' with a smaller diameter and a second region 3" with a larger diameter. The profiling in the example depicted is supposed to be done on region 3" of the blank 3. Typically, it involves a toothlike profile running parallel to the axis of the blank. Such inside and outside profiled workpieces are used, for example, for two-part telescopic tubes to form telescopic connections in vehicle construction.

At the left side there is formed a pressure pad 4, having a lengthwise movable spindle sleeve 5. In the area of the resting position of the tip 5' of the spindle sleeve 5 are depicted schematically in the form of two circles the mechanical means of machining 6 that act on the blank 3 radially from the outside. For example, the means of machining are familiar rotating impact rolls, which are brought to engage with the surface of the blank 3 in a circular orbital path and thereby produce the profiling on the blank 3 according to the shape of the mandrel 2.

For this, in familiar manner, the end face of the mandrel 2 is introduced from right to left into the opening of the blank 3 and the mandrel 2 is then brought together with the blank 3 up against the spindle sleeve 5. After this, the profiling is done under intermittent rotational movement and lengthwise displacement of the mandrel 2 relative to the means of machining 6.

After the profile has been formed, the mandrel 2 is again pushed back to its position of rest at the right side and the now-finished blank 3 is stripped off the mandrel 2 and taken away by separate means.

It is clear from this representation that, depending on the overall length of the blank 3, the mandrel 2 as well needs to be configured to corresponding length and so too the distance between the headstock 1 and the pressure pad 4. Moreover, the mandrel 2 has to be able to travel not only completely into the blank 3 but also completely out from the blank 3, in order for the latter to be brought up and then taken away again.

Figure 2:
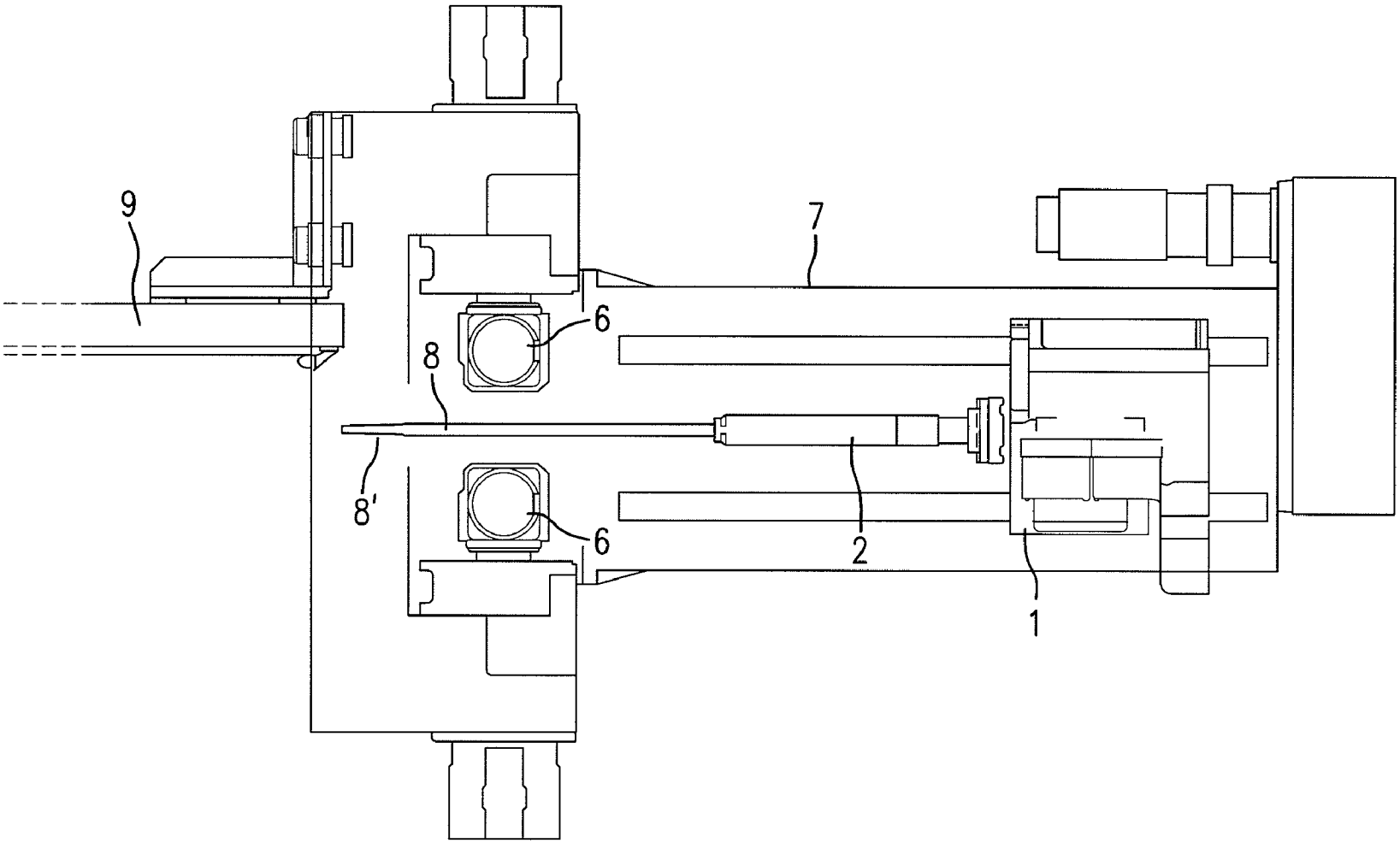
FIG. 2 shows, schematically, a view of the primary headstock and the machining region of a device according to the invention.
Figure 3:
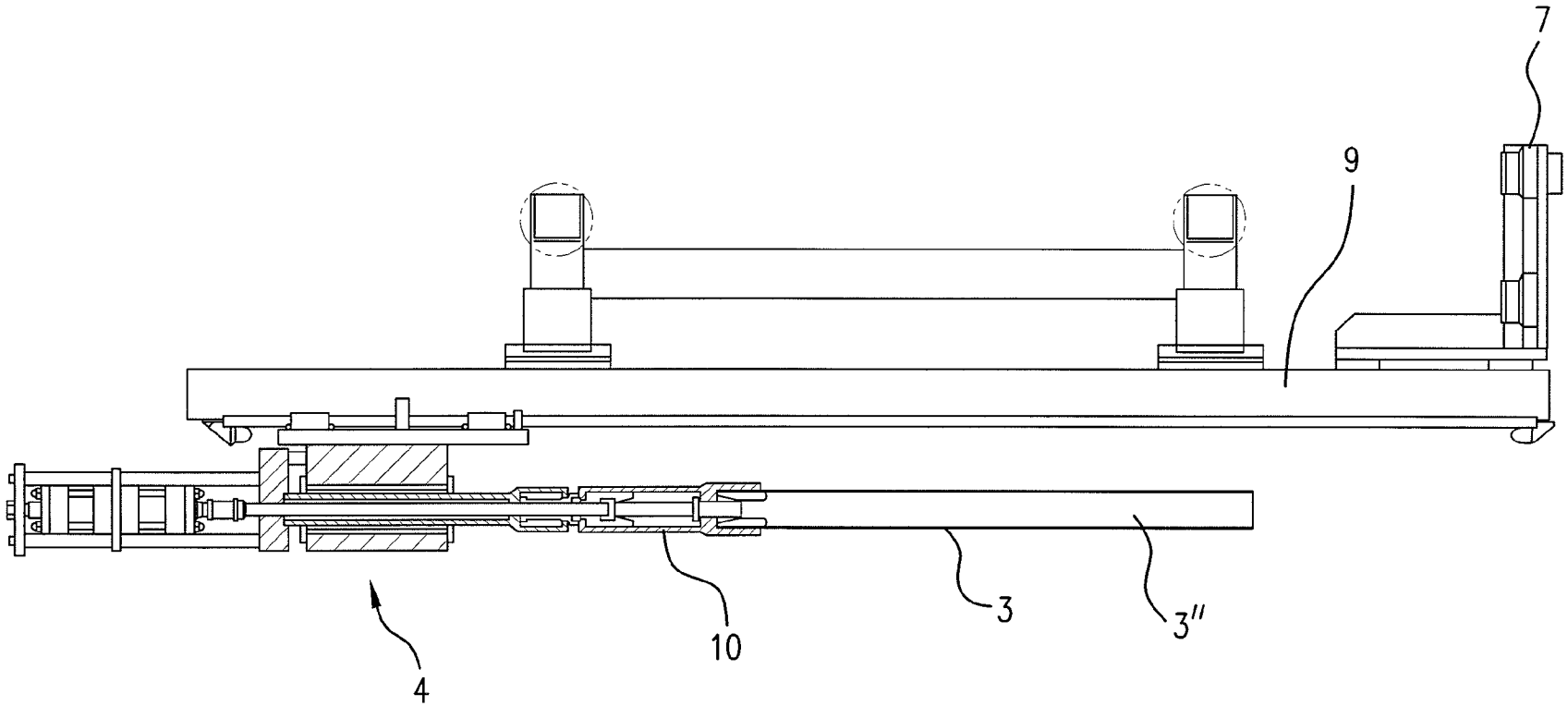
FIG. 3 is a view of the secondary headstock of the invented device according to FIG. 2.

Now, in order to be able to handle even longer tubes or blanks 3, the invention proposes a device according to FIG. 2 and FIG. 3.

A primary headstock 1 is arranged here, again, able to move lengthwise in the machine frame 7 of the machining device. From the primary headstock 1, again, the mandrel 2 is driven intermittently in rotation about its lengthwise axis. Furthermore, the means of machining 6 are arranged on the machine frame 7, so as to be able to work radially in relation to the axis of the primary headstock. For example, here as well, the means of machining 6 are configured as impact rolls. Thus, all driving means or driving axles for both the movement of the primary headstock 1 and therefore the mandrel, and for the means of machining 6, are arranged on the machine frame 7.

Moreover, now, a lance 8 is formed coaxial to the mandrel 2, which can move axially and be led through the mandrel 2. The left end of the lance 8 is held in a drive unit, which allows an axial movement of the lance 8 relative to the primary headstock 1. For clarity, this drive unit is not depicted in FIG. 2. The drive unit can be, for example, a hydraulic cylinder, making it possible to apply a large static pulling force to the lance 8 in the direction of the primary headstock 1.

The free end of the lance 8 is provided with a toothing or grooves in the region of the tip 8', as will be further described below.

Opposite the tip 8' of the lance, in a prolongation of the axis of the primary headstock, there is arranged a lengthwise movable secondary headstock 4 on a beam 9 of the machine frame 7, as is shown in FIG. 3.

This secondary headstock 4 has a clamping mechanism 10 in the form of a collet chuck for holding the blank 3. The end face of the region 3" of the blank 3 that is being worked is directed toward the primary headstock 1, while the end of the region 3' not being worked is secured in the clamping mechanism 10.

The secondary headstock 4 in this resting or loading position is situated so far to the left of the region of the means of machining 6 that the entire length of the blank 3 is also situated to the left outside of the region of the means of machining 6. Thus, the blank 3 prior to the machining can be easily and automatically fed to the clamping mechanism 10 by means of suitable feeding means (not shown here) and also removed again once the machining of the blank 3 is complete, without having to reach into the region of the machine frame 7 with the means of machining 6.

Thanks to this arrangement, in particular the mandrel 2 only needs to be configured to the length of the region 3" being worked of the blank 3 and therefore the length of the guides of the primary headstock 1 for this lengthwise movement is also correspondingly short. Moreover, the length of the machine frame in the region of the primary headstock 1 and the means of machining 6 can also therefore be relatively short, corresponding to the length of the region 3" being worked, even for relatively long blanks 3, and does not have to extend, as in the traditional layouts, over at least the full length or as much as twice the length of the blank 3.

Figure 4:
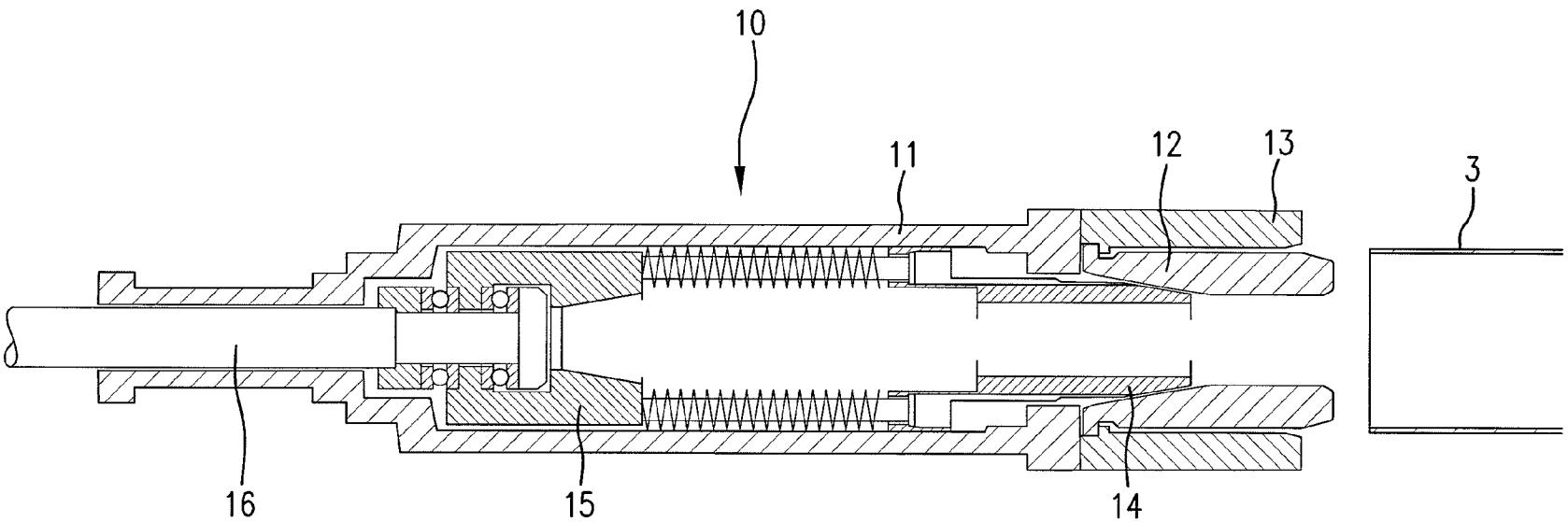
FIG. 4 is a lengthwise section through the clamping device of the secondary headstock of the device according to FIG. 3 in the loading position.

The clamping mechanism 10 is arranged and is free to rotate in the lengthwise movable headstock 4, as can be seen from FIG. 3 in lengthwise cross section. The clamping mechanism 10 advantageously has a cylindrical envelope 11, inside whose right end is arranged a collet chuck 12. The end of the blank 3 can be pushed in between the collet chuck 12 and the cylindrical gap formed by the clamping ring 13 arranged around it, as shown in FIG. 4.

The collet chuck 12 is activated by means of a cone 14 which can move lengthwise in the envelope 11. The cone 14 is spring loaded against a clamping piston 15, likewise arranged to be movable in the envelope 11, and being mounted and supported so that it can rotate on the activating rod 16.

Figure 5:
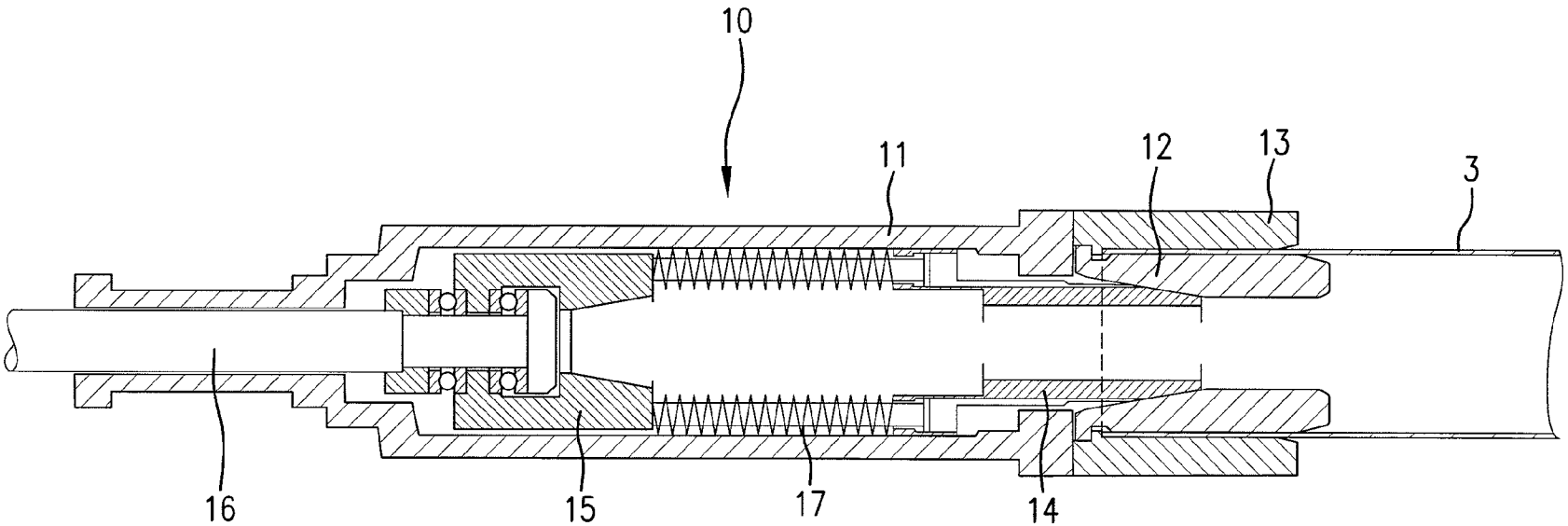
FIG. 5 is a lengthwise section according to FIG. 4 with blank in place.

FIG. 5 shows the blank 3 inserted and secured between the collet chuck 12 and the clamping ring 13. The clamping piston 15 has been pushed against the collet chuck 12 in the envelope 11 and thus the cone 14 presses via the spring 17 against the inside of the collet chuck 12 and thereby secures the blank 3 in the corresponding position.

Figure 6:
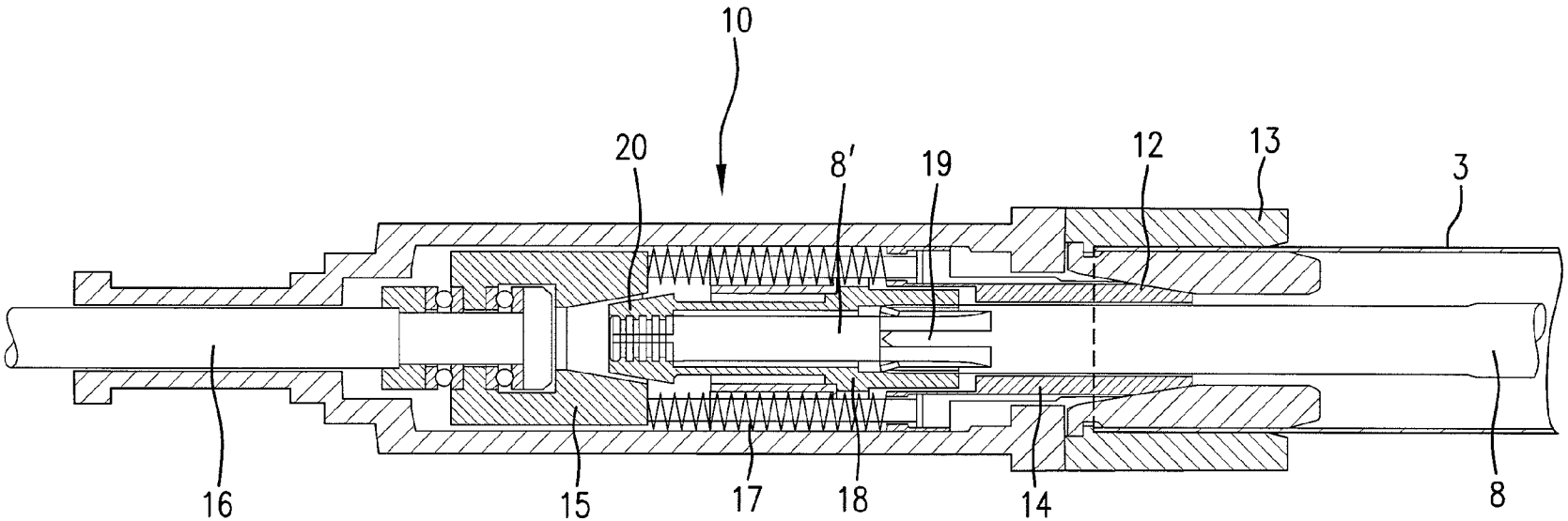
FIG. 6 is a lengthwise section according to FIG. 4 with the tip of the lance introduced.

Now, in order to achieve a torsion-proof connection between the clamping mechanism 10 and the mandrel 2, a lengthwise movable rotation driver 18 is further arranged in the envelope 11, as is shown by FIG. 6. This rotation driver 18 is not represented in FIGS. 4 and 5 for sake of better visibility.

By pushing in the tip 8' of the lance 8, now, a form-fitting connection is produced between the lance 8 and the rotation driver 18. For this, the lance 8 has a longitudinal toothing 19 in the region of its tip 8', which engages with corresponding slots of the rotation driver 18. Since the front edges of the longitudinal toothing 19 are shaped as wedges, the rotation driver 18 and the clamping mechanism 10 are automatically positioned at the correct twist.

Figure 7:
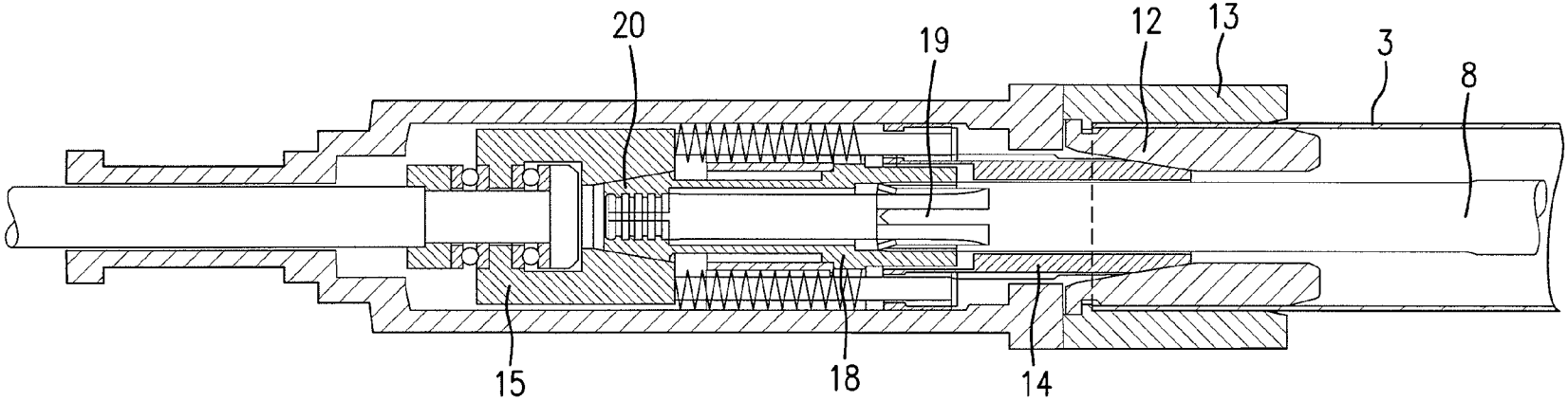
FIG. 7 is a lengthwise section according to FIG. 4 in the operating condition with the lance clamped and the blank tight.

FIG. 7, finally, shows the clamping mechanism 10 and lance 8 fully joined together. The rear region 20 of the rotation driver 18 is configured in conical shape as a collet chuck and its inside has radial circumferential grooves, with which the radially traveling ribs of the tip of the lance 8 can mate in a form-fitting manner. Thanks to the pressure of the clamping piston 15 toward the right, this now makes contact with the rotation driver 18 by friction and form fitting and thereby forms the axial connection for the clamping process. The lance 8 can now be drawn by its drive unit to the right toward the primary headstock 1 and placed under tension, so that the blank 3 is now firmly clamped for machining by means of the rotation driver 18 and the collet chuck 12 and pressed in a torsion-proof manner against the stop on the mandrel 2.

This configuration of the clamping mechanism 10 thus allows the blank 3 to be seized and secured at its region 3' not being worked. The movement for the securing is accomplished by a lengthwise drive unit arranged at the secondary headstock 4, for example an electric or hydraulic drive unit, which moves the clamping piston 15 in the envelope 11 of the clamping mechanism 10 toward the blank 3.

The clamping mechanism 10 joined by the lance 8 to the primary headstock 1 is now moved axially together with the blank 8 through the working region of the means of machining 6, accomplishing an intermittent rotation of the blank 3 by virtue of the drive unit of the mandrel 2.

The profiling of the blank 3 now occurs preferably by means of the impact rolls of the means of machining 6 in familiar manner. Depending on the choice of shape of the impact rolls, either profiled or flat rolls, the blank 3 can be profiled on the inside and outside, or only on the inside.

After the configuration of the profile of the blank 3 is complete, being generally a longitudinal tooth meshing, the finished blank 3 after radial feeding of the means of machining 6 can be secured in this position and held by the feeding mechanism. In this way, the mandrel 2 with the primary headstock 1 can now be pulled to the right away from the blank 3. After this, the means of machining 6 can again travel back to their position of rest, and then the blank 3, by retraction of the clamping mechanism 10 with the secondary headstock 4 into the starting position, can be pulled back into the region of the loading device. After the releasing of the clamped connection in the clamping mechanism 4, the blank 3 can now be unloaded from the loading zone and a new blank 3 fed to the clamping mechanism 4, as described above.

Another benefit of this device and this method is that the mandrel 2 by virtue of its relatively short length can be easily changed. Preferably, this can be done through a quick-change device, so as to refit the layout to a different tooth-meshing configuration. This enables-a faster and easier changing of the mandrel 2 as compared to the traditional method. Another advantage is that the loading and subsequent removal of the finished blank 3 can make use of this same device.

With the invented method and device, for example blanks with an outer diameter of between 20 mm and 200 mm and a length up to 6000 mm can be handled, having a region to be worked with a length up to 1000 mm. Such thin-walled tubes can have a wall thickness between 1.0 mm and 8.0 mm and can be subsequently assembled to form a high-precision telescopic tube. The blanks consist of steel or other materials. Of course, even shorter tubes with shorter regions to be worked can also be handled with the method and the device.

The invention claimed is:

1. Method for making at least partly profiled tubes, at least on the inside, from a hollow cylindrical blank by mechanical cold-forming, the method comprising:

feeding an end of the blank not to be worked to a clamping mechanism, clamping the blank in the clamping mechanism to hold the blank, introducing a mandrel arranged on a primary headstock into the end of a region of the blank that is to be worked, axially moving a lance with a free end coaxially through the mandrel and the blank, and into the clamping mechanism, bringing the lance into a form-fitting connection with the clamping mechanism at least in regard to traction and rotation, passing the mandrel axially through a stationary machining stage together with the clamping mechanism and the blank, so that the machining stage works radially on the surface of the blank from the outside, along a segment being worked, in order to create at least the inner profiling of the blank.

2. Method according to claim 1, including driving the mandrel axially and in intermittent rotation via a drive unit arranged on the primary headstock.

3. Method according to claim 1, wherein said profiling of the blank is performed by a mechanical cold-forming, impact rolling method involving consecutive radial beating or hammering by rolls on the blank, thereby achieving said at least the inner profiling of the blank.

4. Method according to claim 1, further comprising, after the working of the blank, advancing the machining stage onto the blank in at least partly form-fitting manner, drawing out the mandrel from the blank, retracting the machining stage from the form-fitted engagement and the blank, moving the clamping mechanism out from the working region to an original loading zone, picking up the finished blank with a transfer mechanism, and releasing the clamping mechanism.

5. Method according to claim 1, including holding the blank in the clamping mechanism by means of a tightening mechanism wherein tightening is at least partly achieved by means of spring force.

6. Method according to claim 1, including connecting the primary headstock and the clamping mechanism in relation to axial displacement by a form-fitted and/or frictional connection, and in relation to rotation by a form-fitted and/or frictional connection, using a driver arranged in the clamping mechanism.

7. Method according to claim 1, wherein hydraulic force is used to apply tractive force to the lance for the holding of the blank in the clamping mechanism and against the mandrel at the primary headstock.

8. Method according to claim 1, further comprising changing the mandrel between different machining processes using a quick-change mechanism.

9. Device for carrying out a method of making at least partially profiled tubes, at least on the inside, from a hollow cylindrical blank by mechanical cold-forming, the device comprising:

a primary headstock movable along a primary headstock axis;

a mandrel able to travel axially along the primary headstock axis with the primary headstock;

a secondary headstock;

a stationary machining station with cold-forming tools working radially to the primary headstock axis;

wherein the secondary headstock is arranged axially opposite the primary headstock, with a clamping mechanism able to travel coaxially to the primary headstock relative to the machining station;

wherein the machining station is arranged stationary between the primary headstock and the secondary headstock; and wherein the device further comprises a lance which is axially movable with respect to the mandrel and which is arranged axially symmetrically inside the mandrel , said lance having an axial toothing in a front region of the lance and having radially traveling grooves at an end face of the lance.

10. Device according to claim 9, wherein the primary headstock is fitted with an intermittently moving rotation drive.

11. Device according to claim 9, wherein the clamping mechanism has a hollow cylindrical envelope, a collet chuck arranged in the hollow cylindrical envelope, and a cone, which can be brought to bear axially against the collet chuck from the inside.

12. Device according to claim 9, wherein the clamping mechanism has a clamping piston connected to an activating rod.

13. Device according to claim 9, wherein the clamping mechanism has a rotation driver able to travel axially inside the clamping mechanism one end of the rotation driver being configured as a clamping piston with an outer conical surface and a profiled inner surface, with circumferential grooves.

* * * * *